US005403410A

United States Patent [19]

Shikanai et al.

[11] Patent Number: 5,403,410

[45] Date of Patent: * Apr. 4, 1995

[54] ABRASION-RESISTANT STEEL

[75] Inventors: Nobuo Shikanai; Yasunobu Kunisada; Tetsuya Sanpei; Kazunori Yako; Kenji Hirabe, all of Kawasaki, Japan

[73] Assignee: NKK Corporation, Tokyo, Japan

[ * ] Notice: The portion of the term of this patent subsequent to Aug. 17, 2010 has been disclaimed.

[21] Appl. No.: 114,978

[22] Filed: Aug. 31, 1993

Related U.S. Application Data

[63] Continuation of Ser. No. 847,726, Mar. 6, 1992, abandoned, which is a continuation-in-part of Ser. No. 621,587, Dec. 3, 1990, abandoned.

[30] Foreign Application Priority Data

Jun. 6, 1990 [JP] Japan ..... 2-148400

[51] Int. Cl.[6] ..... C22C 38/12; C22C 38/26; C22C 38/48

[52] U.S. Cl. ..... 148/328; 420/127; 420/110

[58] Field of Search ..... 148/328, 335; 420/127, 420/110

[56] References Cited

U.S. PATENT DOCUMENTS

| | | | |
|---|---|---|---|
| 2,905,577 | 9/1959 | Harris et al. . | |
| 4,075,041 | 2/1978 | Ueno et al. . | |
| 4,328,032 | 5/1982 | Mancini et al. . | |
| 4,826,543 | 5/1989 | Yano et al. . | |
| 4,946,516 | 8/1990 | Yano et al. . | |

FOREIGN PATENT DOCUMENTS

| | | | |
|---|---|---|---|
| 0523801 | 2/1956 | Belgium | 420/126 |
| 647987 | 5/1964 | Belgium | 420/126 |
| 0231864 | 8/1987 | European Pat. Off. . | |
| 861706 | 1/1951 | Germany . | |
| 917674 | 9/1954 | Germany . | |
| 945150 | 1/1956 | Germany | 420/126 |
| 1483210 | 3/1969 | Germany . | |
| 2408721 | 10/1974 | Germany | 420/126 |
| 47-3383 | 1/1972 | Japan | 148/328 |
| 52-13418 | 2/1977 | Japan | 420/126 |
| 54-38571 | 11/1979 | Japan | 148/328 |
| 57-051243 | 3/1982 | Japan . | |
| 59-185760 | 10/1984 | Japan . | |
| 60-245768 | 12/1985 | Japan . | |
| 61-079745 | 4/1986 | Japan . | |
| 61-117245 | 6/1986 | Japan . | |
| 61-221354 | 10/1986 | Japan . | |
| 61-238940 | 10/1986 | Japan . | |
| 62-142726 | 6/1987 | Japan . | |
| 63-169359 | 7/1988 | Japan . | |
| 1-142023 | 6/1989 | Japan . | |
| 2-194115 | 7/1990 | Japan . | |
| 2-220735 | 9/1990 | Japan . | |
| 3-202422 | 9/1991 | Japan . | |
| 377540 | 6/1964 | Switzerland . | |
| 982955 | 2/1965 | United Kingdom . | |
| 1060605 | 3/1967 | United Kingdom . | |
| 1176855 | 1/1970 | United Kingdom . | |
| 1218927 | 1/1971 | United Kingdom | 148/328 |
| 1235220 | 6/1971 | United Kingdom . | |
| 1248434 | 10/1971 | United Kingdom . | |
| 1253552 | 11/1971 | United Kingdom . | |

(List continued on next page.)

OTHER PUBLICATIONS

Stahl und Eisen, vol. 104, No. 22, 29 Oct. 1984, Dusseldorf DE pp. 1176–1184; Bechet et al.: "Verschleissbestandige Bleche", pp. 1182–1183; tables 1, 2: Steel Usirac 320; VSS 10 and Armco SSS.

(List continued on next page.)

*Primary Examiner*—Deborah Yee

*Attorney, Agent, or Firm*—Frishauf, Holtz, Goodman & Woodward

[57] ABSTRACT

An abrasion-resistant steel consists essentially of 0.05 to 0.45 wt. % C, 0.1 to 1 wt. % Si, 0.1 to 2 wt. % Mn, 0.05 to 2 wt. % Nb and the balance being Fe and inevitable impurities, the steel includes at least 200 of precipitates of 15 μm or more in particle size per 1 $mm^2$ and the precipitates contains Nb.

In addition to the above basic elements, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B or at least one element selected from the group consisting of 0.003 to 0.05 wt. % Ti and 0.01 to 1 wt. % V is added to steel.

45 Claims, 2 Drawing Sheets

FOREIGN PATENT DOCUMENTS

| | | | |
|---|---|---|---|
| 1253739 | 11/1971 | United Kingdom . | |
| 1253740 | 11/1971 | United Kingdom . | |
| 1338285 | 11/1973 | United Kingdom . | |
| 2122644 | 1/1984 | United Kingdom . | |
| 2244718 | 12/1991 | United Kingdom . | |
| 168323 | 11/1965 | U.S.S.R. . | |
| 271807 | 1/1969 | U.S.S.R. . | |
| 272564 | 6/1970 | U.S.S.R. | 420/126 |
| 441336 | 5/1973 | U.S.S.R. . | |

OTHER PUBLICATIONS

Patent Abstracts of Japan, vol. 11, No. 369 (C-461) (2816) 2 Dec. 1987 of JP-A-62 142 726 (Kobe Steel).

Patent Abstracts of Japan, vol. 12, No. 446 (C-546) (3293) 24 Nov. 1988 of JP-A-63 169 359 (Sumitomo Metal).

Patent Abstracts of Japan, vol. 13, No. 399 (C-632) (3747) 5 Sep. 1989 of JP-A-1 142 023 (Kobe Steel) 2 Jun. 1989.

World Patents Index, Week 7130, Derwent Publications Ltd., London, GB; AN 71-50199S of JP-B-46 026 212 (Sumitomo Metal) 1971.

Patent Abstracts of Japan, vol. 6, No. 174(C-123) (1052) 8 Sep. 1982 of JP-A-57 089 426 (Shin Nippon Seitetsu).

Patent Abstracts of Japan, vol. 12, No. 312 (C-523) 24 Aug. 1988 of JP-A-63 083 225 (Kawasaki Steel).

Patent Abstracts of Japan, vol. 11, No. 273 (C-445) 4 Sep. 1987 of JP-A-62 077 416 (Kawasaki Steel).

ABRASION-RESISTANT STEEL

This application is a continuation of application Ser. No. 07/847,726, filed Mar. 6, 1992, now abandoned, which is a continuation-in-part of Ser. No. 07/621,587, filed Dec. 3, 1990, now abandoned.

BACKGROUND OF THE INVENTION

The present invention relates to an abrasion resistant steel used in the fields of construction, civil engineering and mining such as in power shovel, bulldozer, hopper and bucket.

DESCRIPTION OF THE RELATED ART

Abrasion resistant steels are used in the fields of construction, civil engineering and mining such as in power shovel, bulldozer, hopper and bucket to keep the service lives of these machines or their parts. Since abrasion resistance of steel is increased by increasing hardness of steel, steel having a high hardness manufactured by applying heat treatments such as quenching and the like to an alloyed steel has previously been used, Methods for manufacturing an abrasion-resistant steel with high hardness are disclosed in Japanese Patent Application Laid Open No. 142726/87, No. 169359/88 and No. 142023/89. It is an object of those methods to obtain an abrasion-resistant steel by determining the Brinell Hardness of steel at about 300 or more and improving weldability, toughness and workability in bending. That is, the abrasion resistance of steel is obtained by attaining a high hardness of steel.

In recent years, however, the properties required for abrasion-resistant steel have become severer and the essential solution to a higher abrasion resistance of steel will not be obtained by simply increasing the hardness of steel. A steel having the highest hardness out of the abrasion-resistant steel with high hardness which has been put to practical use has a hardness of about 500, When the hardness of the steel is further enhanced on the basis of the conventional technology to increase the abrasion resistance of the steel, weldability and workability of the steel deteriorate and the production cost greatly increases due to a high alloying. When the hardness of steel is enhanced to 600 or more, it becomes impossible to bend the steel practically. Accordingly, it is easily anticipated that it is difficult in practical use to greatly increase the hardness of steel for the purpose of increasing the abrasion resistance of commercial steel. On the other hand, when attempts are made to improve the workability and weldability of steel by lowering the hardness of the steel, the abrasion resistance of the steel which is the most important property of the abrasion-resistant steel has to be sacrificed.

in view of the above-described prior art problems, the present invention is intended to provide an abrasion-resistant steel, which has a good abrasion resistance although it has a hardness of 500 or less, taking into consideration the workability of the steel in practical use and an abrasion-resistant steel, which has an abrasion resistance superior to that of the conventional steel although it has a low hardness of about 300.

The present inventors have studied the effects of alloying elements and precipitates on the abrasion resistance of steel and have succeeded in greatly increasing only the abrasion resistance of steel without increase of the hardness of the steel.

SUMMARY OF THE INVENTION

It is an object of the present invention to provide an abrasion-resistant steel obtained by increasing only the abrasion resistance of steel without greatly increasing the hardness of steel.

The present invention provides an abrasion-resistant steel consisting essentially of 0.05 to 0.45 wt. % C, 0.1 to 1 wt. % Si, 0.1 to 2 wt. % Mn, 0.05 to 2 wt. % Nb and the balance being Fe and inevitable impurities, said steel including at least 200 of precipitates of 1 $\mu$m or more in average particle size per 1 $mm^2$ and said precipitates containing Nb.

The present invention provides another abrasion-resistant steel consisting essentially of 0.05 to 0.45 wt. % C, 0.1 to 1 wt. % Si, 0.1 to 2 wt. % Mn, 0.05 to 2 wt. % Nb, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % and the balance being Fe and inevitable impurities, said steel including at least 200 of precipitates of 1 $\mu$m or more in average particle size per 1 $mm^2$, which contains Nb and said precipitates containing Nb.

The present invention provides still another abrasion-resistant steel consisting essentially of 0.05 to 0.45 wt. % C, 0.1 to 1 wt. % Si 0.1 to 2 wt. % Mn, 0.05 to 2 wt. % Nb, at least one element selected from the group consisting of 0.003 to 0.05 wt. % Ti and 0.01 to 1 wt. % V and the balance being Fe and inevitable impurities, said steel including at least 200 of precipitates of 1 $\mu$m or more in average particle size per 1 $mm^2$ and said precipitates containing Nb.

The present invention provides yet another abrasion-resistant steel consisting essentially of 0.05 to 0.45 wt. % C, 0.1 to 1 wt. % Si, 0.1 to 2 wt. % Mn, 0.05 to 2 wt. % Nb, at least one element selected from the group consisting of 0.1 to 2 wt. % Cu, 0.1 to 10 wt. % Ni 0.1 to 3 wt. % Cr, 0.1 to 3 wt. % Mo and 0.0003 to 0.01 wt. % B, at least one element selected from the group consisting of 0.003 to 0.05 wt. % Ti and 0.01 to 1 wt. % V and the balance being Fe and inevitable impurities, said steel including at least 200 of precipitates of 1 $\mu$m or more in average particle size per 1 $mm^2$ and said precipitates containing Nb.

The above objects and other objects and advantages of the present invention will become apparent from the following detailed description, taken in conjunction with the appended drawings.

DESCRIPTION OF THE PREFERRED EMBODIMENT

Figure 1:
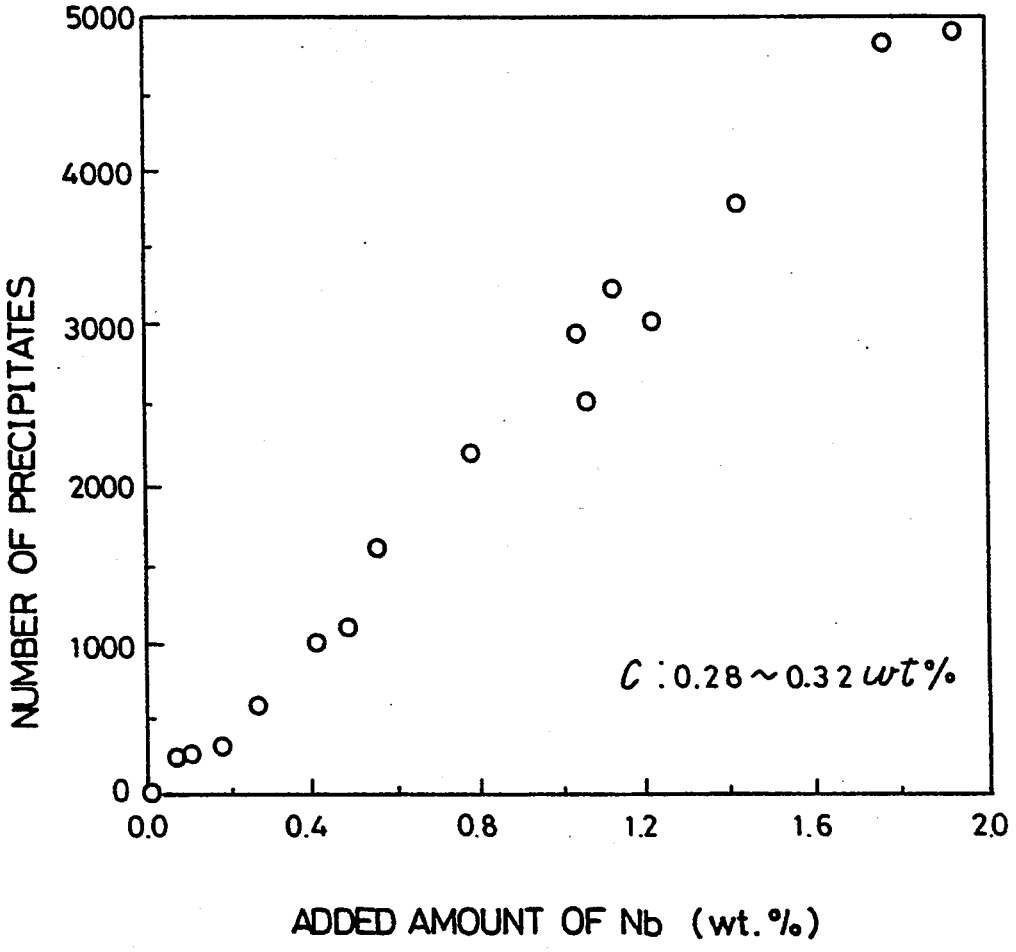
FIG. 1 is a graphical representation showing the relationship between the added amount of Nb and the number of precipitates of Nb of the present invention.

The most significant feature of the present invention is to increase the abrasion resistance of steel by adding a great amount of Nb to steel and effectively utilizing hard coarse precipitates containing Nb, that is, by precipitating and dispersing a great amount of precipitates containing Nb in steel. The precipitates containing Nb are NbC and NbN. When Ti and/or V are present, they form precipitates as disclosed in Ser. No. 07/847,723 filed Mar. 6, 1992, particularly on page 6 thereof. Accordingly, it is unnecessary in the present invention to enhance hardness of abrasion-resistant steel by only transforming the structure of steel to a martensite, which is the conventional way of enhancing the abrasion resistance of steel. In this invention, the abrasion resistance of steel is improved notwithstanding that the steel of the present invention has the hardness equal to or less than that of the conventional steel.

A steel having the Nb content out of the conventional steels is known. It is an object of addition of Nb to steel to increase a matrix hardness by forming fine carbide or to make crystal grains finer. The amount of Nb added to the commercial steel is usually within the range of less than 0.05 wt. %. From the aforementioned object a particle size of each of the precipitates containing Nb has been required to be limited to 0.1 μm or less. In this way, the addition of a great amount of Nb to steel and the existence of the coarse precipitates are regarded as rather harmful for the abrasion resistance of steel. Accordingly, the effect produced by the addition of a great amount of Nb to steel and the influence of coarse precipitates of Nb of 1.0 μm or more in particle size have not been studied in detail.

The present inventors have found that the abrasion resistance of steel can be greatly enhanced by adding a great amount of Nb beyond the traditional common sense, precipitating and dispersing a great amount of precipitates containing Nb of 1 μm or more in average particle size without increasing the hardness of the steel. Since those coarse precipitates containing Nb do not contribute to the precipitation hardening, the strength and hardness of steel are not increased. Accordingly, only the abrasion resistance of steel of the present invention, which has a hardness equal to that of the prior art steel or smaller than that of the prior art steel, can be greatly increased.

The reason why the contents of elements of the invented steel are specified will now be described as follows:

C is an indispensable element in formation of the precipitates of Nb and has an effect of increase of the hardness of steel. When a great amount of C is added to steel, the weldability and workability of steel are deteriorated. Therefore, the upper limit of addition of C is determined at 0.45 wt. %. The lower limit of addition of C is determined at 0.05 wt. % which is an amount necessary for realizing the effect of carbide of Nb.

Si is an element effective in deoxidation process of steel making and a minimum addition of 0.1 wt. % Si is required for this purpose. Si is also an effective element for solution hardening. However, an addition of Si to steel over 1 wt. % lowers the toughness of steel and increases inclusions in steel.

In consequence, the content of Si in steel is limited to a range of from 0.1 to 1 wt. %.

Mn is an element effective in quenching hardenability of steel. From this point of view, at least 0.1 wt. % Mn is required for this purpose. However, when the Mn content exceeds 2 wt. %, the weldability of steel is deteriorated. Therefore, the Mn content is determined at 0.1 to 2 wt. %.

Nb is one of the most important element as is C. The addition of at least 0.05 wt. % Nb is required to stably form a great amount of coarse precipitates containing Nb. 0.2 wt. % Nb or more is required to be added to steel to stably generate a greater amount of precipitates containing Nb and to secure a better abrasion resistance of steel. FIG. 1 is a graphical representation showing the relationship between the added amount of Nb and the amount of the precipitates containing Nb. When more than 2 wt. % Nb is added to steel, the steel possesses good abrasion resistance. However, a high cost is required for the production. The weldability and workability of steel are lowered. Therefore, the Nb content is required to be 0.05 to 2 wt. % and preferably 0.2 to 2 wt. %.

In addition to the above basic elements, if necessary, at least one element selected from the group consisting of Cu, Ni, Cr, Mo and B can be added to steel within the following range to enhance the quenching hardenability.

Cu is an element for enhancing the quenching hardenability of steel. However, when the Cu content is below 0.1 wt. %, the effect is not sufficient. When the Cu content exceeds 2 wt. %, the hot workability of steel is lowered and the production cost is increased. Therefore, the Cu content is determined at 0.1 to 2 wt. %. Moreover, to prevent the production cost from increasing and to secure the effect of addition of Cu to steel, the Cu content is desired to be in the range of 0.2 to 1 wt. %.

Ni is an element which enhances the quenching hardenability of steel. When the Ni content is below 0.1 wt. %, the effect is not sufficient. When the Ni Content exceeds 10 wt. %, the production cost is greatly increased, Therefore, the Ni content is determined at 0.1 to 10 wt. %. Ni also is effective in increase of the low-temperature toughness. To prevent the production cost from increasing and to secure the effect of addition of Ni to steel, the Ni content is desired to be from 0.2 to 1.5 wt. %.

Cr is an element which enhances the quenching hardenability of steel. When the Cr content is below 0.1 wt. %, the effect is not sufficient. When the Cr content exceeds 3 wt. %, the weldability of steel is deteriorated and the production cost is increased. Therefore, the Cr content is determined at 0.1 to 3 wt. %. To prevent the production cost from increasing and to secure the effect of addition of Cr to steel, the Cr content is desired to be from 0.2 to 1.5 wt. %.

Mo is an element which enhances the quenching hardenability of steel. When the Mo content is below 0.1 wt. %, the effect is not sufficient. When the Mo content exceeds 3 wt. %, the weldability of steel is deteriorated and the production cost is increased. Therefore, the Mo content is determined at 0.1 to 3 wt. %. The Mo content is desired to be from 0.1 to 1 wt. % in terms of the production cost.

B is an element whose quenching hardenability is enhanced by adding a very small amount of B to steel. When the B content is below 0.0003 wt. %, the effect is not sufficient. When the B content exceeds 0.01 wt. %, the weldability of steel is deteriorated and simultaneously the quenching hardenability of steel is lowered. Therefore, the B content is determined at 0.000 to 0.01 wt. %. To prevent the production cost from increasing and to secure the effect of addition of B go steel, the B content is desired to be from 0.0005 to 0.00 wt. %.

To increase the precipitation hardening in steel in the present invention, at least one element selected from the group consisting of Ti and V can be added to steel within the following range:

Ti is an element effective in the precipitation hardening of steel and can control the hardness of steel according to the use of steel. When the Ti content is below 0.003 wt. %, the effect is not sufficient. Ti is effective in making the crystal grains finer. However, when the Ti content is over 0.05 wt. %, the weldability of steel is deteriorated and the production cost increases. Therefore, the Ti content is required to be from 0.003 to 0.05 wt. %. To surely have the effect of addition of Ti to steel, the Ti content is desired to be 0.01 wt. % or more.

V is an element effective in the precipitation hardening and can control the hardness of steel according to the use of steel. When the V content is below 0.01 wt. %, the effect is not sufficient. V is also effective in formation of coarse precipitates as is Ti. However, when the V content exceeds 1 wt. %, the weldability of steel is deteriorated. Therefore, the V content is required to be from 0.01 to 1 wt. %. To prevent the production cost from increasing and to secure the effect of addition of V to steel, the V content is desired to be from 0.03 to 0.5 wt. %.

The steel of the present invention is manufactured on condition that 200 or more of coarse precipitates of 1.0 μm in average particle size containing Nb are present per 1 $mm^2$.

The abrasion resistance of steel as the most important feature of steel of the present invention can be obtained by causing the coarse precipitates containing Nb to be present in large quantities in the steel. When the precipitates have a small average particle size of less than 1 μm, the effect of increase of the abrasion resistance is small. Moreover, since the precipitates having such a small particle size is accompanied by the increase of the hardness and strength of steel due to the precipitation hardening, the object of the present invention cannot be attained. Accordingly, the object of the composition of the present invention is the coarse precipitates of 1 μm or more in average particle size.

However, even in the case where the precipitates of 1 μm or more in average particle size are present in steel, when the number of precipitates per 1 $mm^2$ is less than 200, there is little effect of increase of the abrasion resistance of steel. It is understood that a great amount of precipitates numbering 200/$mm^2$ or more are required to obtain the effect of increase of a good abrasion resistance of steel. Accordingly, the steel of the present invention can be manufactured on condition that 200 or more of coarse precipitates of 1.05 μm in average particle, size containing Nb are present per 1 $mm^2$. 500 or more of coarse precipitates containing Nb per 1 $mm^2$ are desired to obtain a better abrasion resistance of steel.

Figure 2:
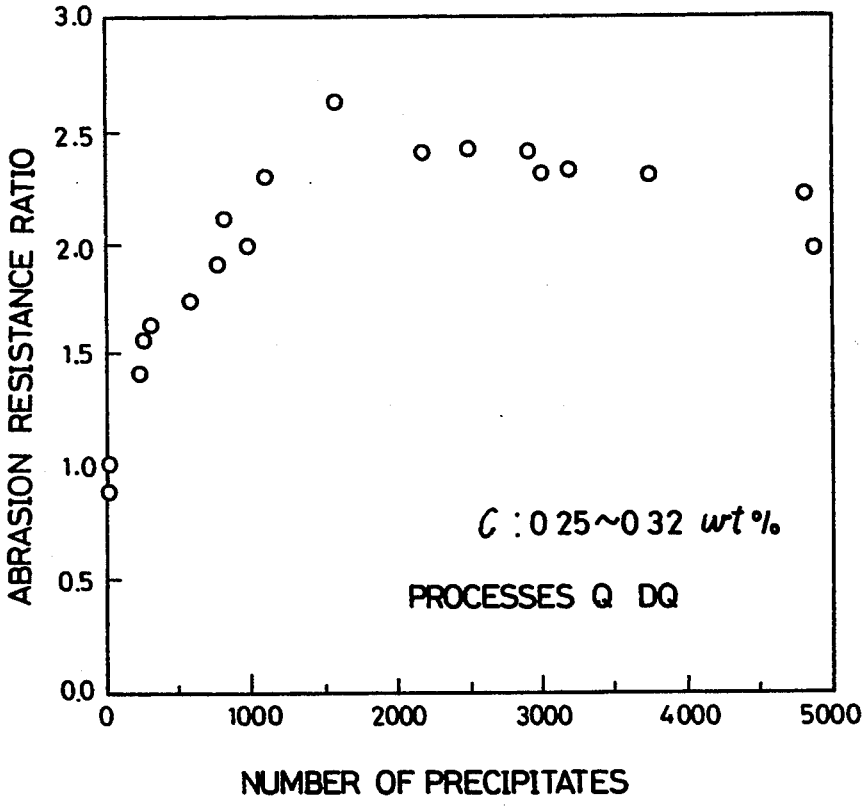
FIG. 2 is a graphical representation showing the relationship between the number (the number of precipitates per 1 $mm^2$) of precipitates of 1.0 $\mu$m or more (50 $\mu$m or less in average particle size) in average particle size of Nb and the abrasion resistance of the present invention.
Figure 3:
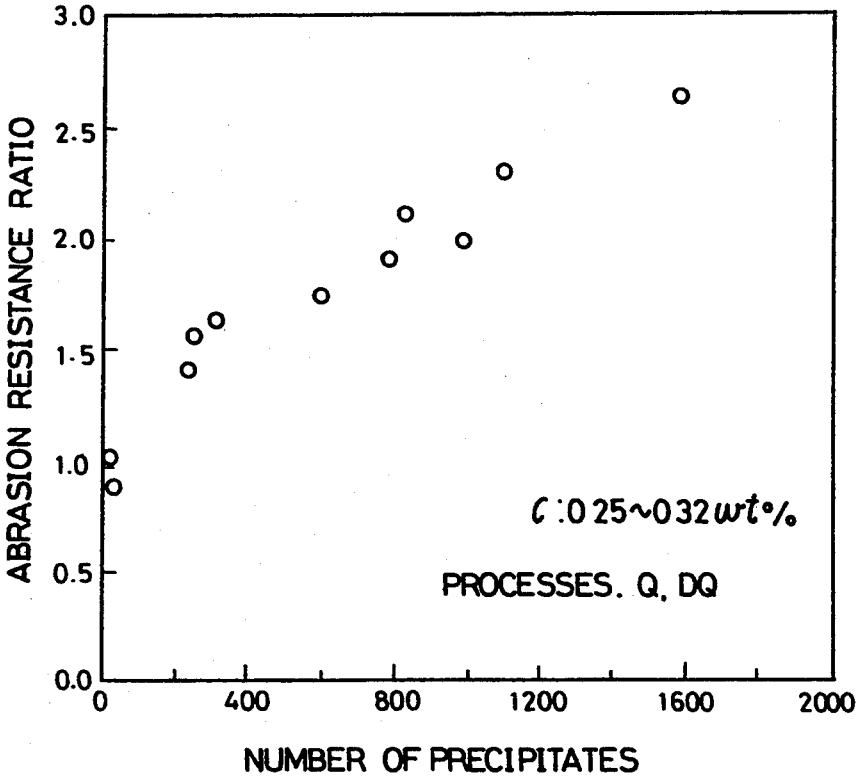
FIG. 3 is a graphical representation showing in detail the range of 2000 of coarse precipitates or less per 1 $mm^2$ in FIG. 2.

FIGS. 2 and 3 are graphical representation showing the relationship between the amount (the number of the precipitates per 1 $mm^2$) of the coarse precipitates containing Nb and the abrasion resistance of steel (the abrasion resistance ratio = the magnification of the abrasion resistance of the objective steel when the abrasion resistance of a steel for comparison is determined at 1). According to this graphical representation, it is clearly seen that when the number of the precipitates is 200/$mm^2$ or more, a good abrasion resistance of steel can be obtained and that when the number of the precipitates is 500/$mm^2$ or more, a better abrasion resistance of steel can be obtained.

However, since the coarse precipitates containing Nb of more than 50μm in average particle size are liable to drop out, the effect of increase of the abrasion resistance cannot be expected. Besides this, since the toughness of steel is greatly decreased when such extremely coarse precipitates are present in steel in large quantities, it is better that the coarse precipitates containing Nb of more than 50 μm in average particle size are not present in steel. Accordingly, it is desirable that 200 or more of precipitates of 50 μm or less in average particle size are present per 1 $mm^2$.

In the present invention, a desired abrasion resistance of steel can be obtained when 200 or more of precipitates of Nb of 1.0 μm or more in average particle size per 1 $mm^2$, and preferably 500 or more of the precipitates of Nb per 1 $mm^2$ are present in steel. As far as this condition is satisfied, there is no trouble even when precipitates other than precipitates containing Nb or precipitates containing Nb of less than 1.0 μm in average particle size are present in steel.

Since a desired abrasion resistance of steel of the present invention can be obtained by only specifying the composition of the steel and the precipitation containing Nb, it is not necessary to specify the working condition and heat treatment condition. Accordingly, the heat treatments such as quenching, annealing, aging and stress relief annealing can be executed optionally and even when those heat treatments of the steel are carried out, the characteristic of the steel of the present invention cannot be impaired.

To generate the aforementioned coarse precipitations of 1.0 μm or more in particle size, it is necessary to control a solidification rate of steel during casting of the steel. The solidification rate is required to be $10^2$ [°C./min ] or less. When the solidification rate exceeds $10^2$ [°C./min ], the solidification rate is extremely great. Even if an amount of Nb satisfying the conditions of the present invention is added to steel, the precipitates become fine as a whole and it becomes difficult to generate 200/$mm^2$ of precipitates of 1 μm or more in average particle size, which should be the condition of the present invention. However, since the solidification rate of less than $1/10^2$ [°C./min] is too slow, the aforementioned extremely coarse precipitates of more than 50 μm are liable to be generated. Accordingly, the solidification rate is desired to be $1/10^2$ [°C./min ] or more.

Steel of the present invention is desired to have hardness of 550 or less as a hardness level of steel for practical use.

EXAMPLE

The chemical compositions of samples are shown in Tables 1 and 2. Samples of from A to S are made of steel of the present invention. Samples of from T to Y are made of the steel for comparison. The comparison steels X and Y are steels whose C content is beyond the range of the present invention (the Nb content is within the range of the present invention).

The process of making steels (15 mm in thickness) manufactured by using each of the samples, the abrasion resistance ratio, the hardness HB (the Brinell Hardness on the surface of the samples) and the amount of precipitates (the number of precipitates of from 1.0 to 50 μm/$mm^2$ in average particle size) are shown in Tables 3 and 4.

An abrasion resistance test was conducted in accordance with ASTM G-65. Silica sand containing 9% $Al_2O_3$-9% $SiO_2$ was used as abrasives. The abrasion resistance ratio is a ratio estimated by a change of weight of steel in an abrasion resistance test. In this test, when the abrasion resistance of the steel for, comparison U-1 having the hardness of 518 was determined at 1.0, the magnification of the abrasion resistance of a sample, namely, [abraded weight of the steel U-1]/[abraded weight of the sample] was represented as an abrasion resistance of the sample. Relative to steel S of the present invention, however, when the abrasion resistance of steel W for comparison having substantially the same composition as that of steel S except for Nb is determined at 1.0, the magnification of the abrasion resistance of the sample is represented as an abrasion resistance of the sample. Accordingly, the greater the abrasion resistance ratio of steel, the better the abrasion resistance of steel.

The processes in the Tables are classified as follows:

AR: as rolled;

Q: as quenched after heated

DQ: as directly quenched after finish rolled at 880° C. following the heating of the slab at 1150° C.;

QT: as tempered at the temperature shown in the parenthesis following Q;

RQ: as quenched after heated to 900° C. following the rolling and air-cooling;

DQT: as tempered at the temperature shown in the parenthesis following DQ; and

According to Tables 3 and 4, any of the steels of the present invention is superior in the abrasion resistance to the steels for comparison. The hardness of the steels of the present invention is 500 or less. It is clearly seen from this that the abrasion resistance of the steels of the present invention is improved without great increase of the hardness. Steel T for comparison is an example of steels A to D of the present invention. The abrasion resistance of steel A of the present invention is 1.62 times greater than that of steel for comparison arid the abrasion resistance of steel D is 2.22 times greater than that of steel U-1 for comparison whereas the abrasion resistance of steel T for comparison is 1.02 times greater than that of steel U-1 for comparison. It is clearly seen from this that the abrasion resistance of steel of the present invention is superior in the abrasion resistance to steel for comparison. The reason why steels of the present invention have the abrasion resistance higher than that of steels for comparison is explained by the existence of 200 or more of coarse precipitates of 1.0 μm or more in average particle size per 1 $mm^2$. Since there are a small amount of coarse precipitates in steel for comparison, the abrasion resistance of steel is not improved.

Notwithstanding that steel D of the present invention has a low hardness of 341, the abrasion resistance of steel D is good. Steel B-1 of the present invention has a hardness equal to that of steel T for comparison, but the abrasion resistance of steel B-1 of the present invention is good. Steels U-1 and U-2 correspond to steels M and G of the present invention. Steels V and W for comparison correspond to steels R and S of the present invention. Those steels for comparison have a small amount of coarse precipitates. Therefore, the hardness of those steels is slightly higher than the hardness of steels of the present invention and the abrasion resistance of those steels are inferior to that of steels of the present invention.

Steels B-2, G-2 and N-2 were subjected to a direct quenching and annealing treatment. The hardness of those steels is remarkably decreased compared with quenched steel. However, the abrasion resistance of those steels is about one and a half times greater than that of quenched steels U-1 for comparison (hardness: 518).

Steel W for comparison, to which steel S of the present invention corresponds, has a low hardness of 300. However, the abrasion resistance of steel S of the present invention is 1.21 times greater than that of steel W for comparison. It is clearly seen from this that steel of the present invention has a sufficiently good abrasion resistance even when it has a low hardness.

Since the C content of steel X for comparison is less than the lower limit specified by the present invention although the Nb content of steel X for comparison satisfies the condition of the present invention, the number of coarse precipitates of 1.0 μm or more in particle size are below the lower limit specified by the present invention. Therefore, the abrasion resistance of this steel for comparison is greatly inferior to that of steel of the present invention.

The content of alloying elements other than C and the number of coarse precipitates in steel Y for comparison are beyond the range of the present invention and only the C content is higher than the upper limit specified by the present invention. This steel for comparison has a good abrasion resistance, but the hardness of this steel is more than 600. In consequence, the workability and weldability of this steel are very bad and it cannot be put to practical use.

As described above, steel of the present invention has a good abrasion resistance, having the hardness equal to or below that of the conventional steel. The steel of the present invention is a good abrasion-resistant steel having a good abrasion resistance, workability and weldability, which has been ever seen. Therefore, it becomes possible to greatly increase the service lives of spare parts of machines which have been greatly abraded and have had a short service lives, and the spare parts which require complicated working and an abrasion resistance can be easily manufactured.

TABLE 1

| | Chemical Composition (wt %) | | | | | | | | | | | |
|---|---|---|---|---|---|---|---|---|---|---|---|---|
| | C | Si | Mn | Cu | Ni | Cr | Mo | Nb | V | Ti | B | |
| A | 0.31 | 0.35 | 1.44 | — | — | — | — | 0.19 | — | — | — | Present Invention |
| B | 0.38 | 0.44 | 1.58 | — | — | — | — | 0.56 | — | — | — | Present Invention |
| C | 0.29 | 0.46 | 1.48 | — | — | — | — | 1.06 | — | — | — | Present Invention |
| D | 0.31 | 0.40 | 1.46 | — | — | — | — | 1.78 | — | — | — | Present Invention |
| E | 0.19 | 0.41 | 1.88 | — | — | — | — | 0.96 | — | — | — | Present Invention |

TABLE 1-continued

| | Chemical Composition (wt %) | | | | | | | | | | | |
|---|---|---|---|---|---|---|---|---|---|---|---|---|
| | C | Si | Mn | Cu | Ni | Cr | Mo | Nb | V | Ti | B | |
| F | 0.32 | 0.40 | 1.38 | 0.31 | 0.52 | — | — | 0.78 | — | — | — | Present Invention |
| G | 0.30 | 0.34 | 1.41 | — | — | 0.98 | 0.25 | 1.22 | — | — | 0.0013 | Present Invention |
| H | 0.24 | 0.32 | 1.37 | 0.21 | 1.52 | 0.58 | 0.19 | 0.89 | — | — | 0.0015 | Present Invention |
| I | 0.28 | 0.25 | 1.61 | — | — | — | — | 1.42 | — | 0.022 | — | Present Invention |
| J | 0.28 | 0.28 | 1.59 | — | — | — | — | 0.41 | 0.44 | 0.041 | — | Present Invention |
| K | 0.29 | 0.25 | 1.82 | — | — | — | — | 1.12 | 0.05 | — | — | Present Invention |
| L | 0.30 | 0.38 | 0.77 | 0.27 | 0.63 | — | — | 0.27 | — | 0.005 | 0.0012 | Present Invention |

TABLE 2

| | Chemical Composition (wt %) | | | | | | | | | | | |
|---|---|---|---|---|---|---|---|---|---|---|---|---|
| | C | Si | Mn | Cu | Ni | Cr | Mo | Nb | V | Ti | B | |
| M | 0.29 | 0.38 | 0.79 | — | — | 0.97 | 0.33 | 0.07 | 0.68 | 0.014 | 0.0010 | Present Invention |
| N | 0.31 | 0.40 | 0.81 | 0.52 | — | 1.08 | 0.23 | 0.11 | 0.82 | 0.014 | 0.0012 | Present Invention |
| O | 0.31 | 0.41 | 0.80 | — | — | 1.18 | 0.14 | 0.49 | — | — | 0.0009 | Present Invention |
| P | 0.30 | 0.37 | 0.71 | — | — | 0.88 | 0.22 | 1.03 | — | 0.016 | 0.0011 | Present Invention |
| Q | 0.28 | 0.35 | 1.12 | — | 0.76 | 0.68 | — | 1.93 | — | — | 0.0015 | Present Invention |
| R | 0.19 | 0.45 | 1.31 | 0.22 | 0.34 | 0.99 | 0.36 | 1.01 | — | — | 0.0015 | Present Invention |
| S | 0.09 | 0.35 | 1.42 | 0.32 | 0.42 | 1.21 | 0.16 | 1.11 | — | 0.015 | 0.0016 | Present Invention |
| T | 0.30 | 0.47 | 1.48 | — | — | — | — | 0.02 | — | — | — | Comparison |
| U | 0.31 | 0.35 | 0.82 | — | — | 0.95 | 0.25 | 0.02 | — | 0.014 | 0.0011 | Comparison |
| V | 0.20 | 0.45 | 1.33 | 0.21 | 0.35 | 1.02 | 0.35 | 0.01 | — | — | 0.0014 | Comparison |
| W | 0.10 | 0.33 | 1.39 | 0.32 | 0.45 | 1.19 | 0.18 | 0.01 | — | 0.012 | 0.0018 | Comparison |
| Y | 0.03 | 0.45 | 1.61 | — | — | — | — | 0.55 | — | — | — | Comparison |
| Z | 0.58 | 0.44 | 1.55 | — | — | — | — | 0.53 | — | — | — | Comparison |

TABLE 3

| | Manufacturing Process | Abrasion Resistance Ratio | Hardness (HB) | Amount of Precipitates of 1.0 μm or more (number/mm$^2$) | |
|---|---|---|---|---|---|
| A | Q | 1.62 | 499 | 320 | Invention |
| B-1 | DQ | 2.63 | 514 | 1592 | Invention |
| B-2 | QT (500° C.) | 1.89 | 313 | 1731 | Invention |
| C | Q | 2.41 | 435 | 2515 | Invention |
| D | Q | 2.22 | 341 | 4823 | Invention |
| E | Q | 1.46 | 266 | 1416 | Invention |
| F-1 | Q | 2.40 | 441 | 2201 | Invention |
| F-2 | AR | 1.39 | 277 | 2290 | Invention |
| G-1 | Q | 2.31 | 390 | 3015 | Invention |
| G-2 | QT (500° C.) | 2.10 | 331 | 2967 | Invention |
| H | Q | 2.11 | 380 | 1759 | Invention |
| I | Q | 2.31 | 373 | 3762 | Invention |
| J | DQ | 1.98 | 474 | 992 | Invention |
| K | Q | 2.32 | 415 | 3214 | Invention |
| L | Q | 1.73 | 492 | 599 | Invention |
| M | DQ | 1.41 | 503 | 235 | Invention |

TABLE 4

| | Manufacturing Process | Abrasion Resistance Ratio | Hardness (HB) | Amount of Precipitates of 1.0 μm or more (number/mm$^2$) | |
|---|---|---|---|---|---|
| N-1 | DQ | 1.55 | 492 | 259 | Invention |
| N-2 | DQT (400° C.) | 1.48 | 417 | 261 | Invention |
| O-1 | Q | 2.30 | 474 | 1103 | Invention |
| O-2 | AR | 1.22 | 290 | 1005 | Invention |
| P-1 | Q | 2.40 | 435 | 2930 | Invention |
| P-2 | AR | 1.35 | 268 | 2998 | Invention |
| Q | Q | 1.98 | 290 | 4892 | Invention |
| R | Q | 1.52 | 259 | 1535 | Invention |

TABLE 4-continued

| | Manufacturing Process | Abrasion Resistance Ratio | Hardness (HB) | Amount of Precipitates of 1.0 μm or more (number/mm²) | |
|---|---|---|---|---|---|
| S | Q | 1.21* | 196 | 901 | Invention |
| T | Q | 1.02 | 504 | 20 | Comparison |
| U-1 | Q | 1.00 | 518 | 18 | Comparison |
| U-2 | AR | 0.89 | 306 | 25 | Comparison |
| V | Q | 0.85 | 432 | 0 | Comparison |
| W | Q | 1.00* | 311 | 0 | Comparison |
| X | Q | 0.61 | 131 | 95 | Comparison |
| Y | Q | 2.71 | 627 | 2638 | Comparison |

What is claimed is:

1. An abrasion-resistant steel consisting essentially of 0.05 to 0.45 wt. % C, 0.1 to 1 wt. % Si, 0.1 to 2 wt. % Mn, 0.05 to 2 wt. % Nb and the balance being Fe and inevitable impurities, said steel including at least 200 of precipitates of 1 μm or more in particle size per 1 mm² and said precipitates containing Nb.

2. The abrasion resistant steel of claim 1, wherein Nb content is from 0.2 to 2 wt. %.

3. The abrasion resistant steel of claim 1, wherein said steel includes at least 500 of precipitates of 1 μm or more in average particle size per 1 mm².

4. The abrasion resistant steel of claim 1, wherein said precipitates have an average particle size of from 1 to 50 μm.

5. An abrasion-resistant steel consisting essentially of 0.05 to 0.45 wt. % C, 0.1 to 1 wt. % Si, 0.1 to 2 wt. % Mn, 0.05 to 2 wt. % Nb, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt % B and the balance being Fe and inevitable impurities, said steel including at least 200 of precipitates of 1 μm or more in average particle size per 1 mm² and said precipitates containing Nb.

6. The abrasion resistant steel of claim 5, wherein Nb content is from 0.2 to 2 wt. %.

7. The abrasion resistant steel of claim 5, wherein said Cu is from 0.2 to 1 wt. %, said Ni is from 0.2 to 1.5 wt. %, said Cr is from 0.2 to 1.5 wt. %, said Mo is from 0.1 to 1 wt. % and said B is from 0.0005 to 0.005 wt. %.

8. The abrasion resistant steel of claim 5, wherein said steel includes at least 500 of precipitates of 1 μm or more in average particle size per 1 mm².

9. The abrasion resistant steel of claim 5, wherein said precipitates have an average particle size of from 1 to 50 μm.

10. An abrasion-resistant steel consisting essentially of 0.05 to 0.45 wt. % C, 0.1 to 1 wt. % Si, 0.1 to 2 wt. % Mn, 0.05 to 2 wt. % Nb, at least one element selected from the group consisting of 0.003 to 0.05 wt. % Ti and 0.01 to 1 wt. % V and the balance being Fe and inevitable impurities, said steel including at least 200 of precipitates of 1 μm or more in average particle, size per 1 mm² and said precipitates containing Nb.

11. The abrasion resistant steel of claim 10, wherein Nb content is from 0.2 to 2 wt. %.

12. The abrasion resistant steel of claim 10, wherein said Ti is from 0.01 to 0.05 wt. % and said V is from 0.03 to 0.5 wt. %.

13. The abrasion resistant steel of claim 10, wherein said steel includes at least 500 of precipitates of 1 μm or more in average particle size per 1 mm².

14. The abrasion resistant steel of claim 10, wherein said precipitates each have an average particle size of from 1 to 50 μm.

15. An abrasion-resistant steel consisting essentially of 0.05 to 0.45 wt. % C, 0.1 to 1 wt. % Si, 0.1 to 2 wt. % Mn, 0.05 to 2 wt. % Nb, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B, at least one element selected from the group consisting of 0.003 to 0.05 wt. % Ti and 0.01 to 1 wt. % V and the balance being Fe and inevitable impurities, said steel including at least 200 of precipitates of 1 μm or more in average particle size per 1 mm² and said precipitates containing Nb.

16. The abrasion resistant steel of claim 15, wherein Nb content is from 0.2 to 2 wt. %.

17. The abrasion resistant steel or claim 15, wherein said steel includes at least 500 of precipitates of 1 μm or more in average particle size per 1 mm².

18. The abrasion resistant steel of claim 15, wherein said precipitates have an average particle size of from 1 to 50 μm.

19. The abrasion resistant steel of claim 3, wherein said precipitates have an average particle size of from 1 to 50 μm.

20. The abrasion resistant steel of claim 19, wherein Nb content is from 0.2 to 2 wt. %.

21. The abrasion resistant steel of claim 8, wherein said precipitates have an average particle size of from 1 to 50 μm.

22. The abrasion resistant steel of claim 21, wherein said Nb is from 0.2 to 2 wt. %, said Cu is from 0.2 to 1 wt. %, said Ni is from 0.2 to 1.5 wt. %, said Cr is from 0.2 to 1.5 wt. %, said Mo is from 0.1 to 1 wt. % and said B is from 0.0005 to 0.005 wt. %.

23. The abrasion resistant steel of claim 13, wherein said precipitates have an average particle size of from 1 to 50 μm.

24. The abrasion resistant steel of claim 23, wherein said Nb is from 0.2 to 2 wt. %, said Ti is from 0.01 to 0.05 wt. % and said V is from 0.03 to 0.5 wt. %.

25. The abrasion resistant steel of claim 17, wherein said precipitates have an average particle size of from 1 to 50 μm.

26. The abrasion resistant steel of claim 25, wherein said Nb is from 0.2 to 2 wt. %.

27. The abrasion resistant steel of claim 1, consisting essentially of 0.31 wt. % C, 0.35 wt. % Si, 1.44 wt. % Mn, and 0.19 wt. % Nb, and the balance Fe and inevitable impurities.

28. The abrasion resistant steel of claim 1, consisting essentially of 0.38 wt. % C, 0.44 wt. % Si, 1.58 wt. % Mn, and 0.56 wt. % Nb, and the balance Fe and inevitable impurities.

29. The abrasion resistant steel of claim 1, consisting essentially of 0.29 wt. % C, 0.46 wt. % Si, 1.48 wt. % Mn, and 1.06 wt. % Nb, and the balance Fe and inevitable impurities.

30. The abrasion resistant steel of claim 1, consisting essentially of 0.31 wt. % C, 0.40 wt. % Si, 1.46 wt. % Mn, and 1.76 wt. % Nb, and the balance Fe and inevitable impurities.

31. The abrasion resistant steel of claim 1, consisting essentially of 0.19 wt. % C, 0.41 wt. % Si, 1.66 wt. % Mn, and 0.96 wt. % Nb, and the balance Fe and inevitable impurities.

32. The abrasion resistant steel of claim 5, consisting essentially of 0.32 wt. % C, 0.40 wt. % Si, 1.38 wt. % Mn, 0.31 wt. % CU, 0.52 wt. % Ni and 0.78 wt. % Nb, and the balance Fe and inevitable impurities.

33. The abrasion resistant steel of claim 5, consisting essentially of 0.30 wt. % C, 0.34 wt. % Si, 1.41 wt. % Mn, 0.98 wt. % Cr, 0.25 wt. % Mo, 1.22 wt. % Nb and 0.0013 wt. % B, and the balance Fe and inevitable impurities.

34. The abrasion resistant steel of claim 5, consisting essentially of 0.24 wt. % C, 0.32 wt. % Si, 1.37 wt. % Mn, 0.21 wt. % Cu, 1,52 wt. % Ni, 0.58 wt. % Cr, 0.19 wt. % Mo, 0.89 wt. % Nb, and 0.0015 wt. % B, and the balance Fe and inevitable impurities.

35. The abrasion resistant steel of claim 10, consisting essentially of 0.28 wt. % C, 0.25 wt. % Si, 1.61 wt. % Mn, 1.42 wt. % Nb and 0.022 wt. % Ti, and the balance Fe and inevitable impurities.

36. The abrasion resistant steel of claim 10, consisting essentially of 0.28 wt. % C, 0.26 wt. % Si, 1.59 wt. % Mn, 0.41 wt. % Nb, 0.44 wt. % V, and 0.041 wt. % Ti, and the balance Fe and inevitable impurities.

37. The abrasion resistant steel of claim 10, consisting essentially of 0.29 wt. % C, 0.25 wt. % Si, 1.62 wt. % Mn, 1.12 wt. % Nb, and 0.05 wt. % V, and the balance Fe and inevitable impurities.

38. The abrasion resistant steel of claim 15, consisting essentially of 0.30 wt. % C, 0.38 wt. % Si, 0.77 wt. % Mn, 0.27 wt. % Cu, 0.63 wt. % Ni, 0.27 wt. % Nb, 0.005 wt. % Ti, and 0.0012 wt. % B, and the balance Fe and inevitable impurities.

39. The abrasion resistant steel of claim 15, consisting essentially of 0.29 wt. % C, 0.38 wt. % Si, 0.79 wt. % Mn, 0.97 wt. % Cr, 0.33 wt. % Mo, 0.07 wt. % Nb, 0.68 wt. % V, 0.014 wt. % Ti, and 0.0010 wt. % B, and the balance Fe and inevitable impurities.

40. The abrasion resistant steel of claim 15, consisting essentially of 0.31 wt. % C, 0.40 wt. % Si, 0.81 wt. % Mn, 0.52 wt. % Cu, 1.08 wt. % Cr, 0.23 wt. % Mo, 0.11 wt. % Nb, 0.82 wt. % V, 0.014 wt. % Ti and 0.0012 wt. % B, and the balance Fe and inevitable impurities.

41. The abrasion resistant steel of claim 5, consisting essentially of 0.31 wt. % C, 0.41 wt. % Si, 0.80 wt. % Mn, 1.16 wt. % Cr, 0.14 wt. % Mo, 0.49 wt. % Nb, and 0.0009 wt. % B, and the balance Fe and inevitable impurities.

42. The abrasion resistant steel of claim 15, consisting essentially of 0.30 wt. % C, 0.37 wt. % Si, 0.71 wt. % Mn, 0.88 wt. % Cr, 0.22 wt. % Mo, 1.03 wt. % Nb, 0.016 wt. % Ti, and 0.0011 wt. % B, and the balance Fe and inevitable impurities.

43. The abrasion resistant steel of claim 5, consisting essentially of 0.28 wt. % C, 0.35 wt. % Si, 1.12 wt. % Mn, 0.76 wt. % Ni, 0.68 wt. % Cr, 1.93 wt. % Nb, and 0.0015 wt. % B, and the balance Fe and inevitable impurities.

44. The abrasion resistant steel of claim 5, consisting essentially of 0.19 wt. % C, 0.45 wt. % Si, 1.31 wt. % Mn, 0.22 wt. % Cu, 0.34 wt. % Ni, 0.99 wt. % Cr, 0.36 wt. % Mo, 1.01 wt. % Nb and 0.0015 wt. % B, and the balance Fe and inevitable impurities.

45. The abrasion resistant steel of claim 15, consisting essentially of 0.09 wt. % C, 0.35 wt. % Si, 1.42 wt. % Mn, 0.32 wt. % Cu, 0.42 wt. % Ni, 1.21 wt. % Cr, 0.16 wt. % Mo, 1.11 wt. % Nb, 0.015 wt. % Ti and 0.0016 wt. % B, and the balance Fe and inevitable impurities.

* * * * *

UNITED STATES PATENT AND TRADEMARK OFFICE

CERTIFICATE OF CORRECTION

PATENT NO. : 5,403,410

DATED : April 4, 1995

INVENTOR(S) : Shikanai et al

It is certified that error appears in the above-indentified patent and that said Letters Patent is hereby corrected as shown below:

Column 1, after "ABRASION-RESISTANT STEEL", delete lines 4-7, and replace with the following paragraph:

--This application is a continuation of application Serial No. 07/847,726 filed March 6, 1992 (abandoned) which was a continuation-in-part of Serial No. 07/621,587 filed on December 3,1990 (abandoned). Said Serial No. 07/621,587 was replaced by a continuation application Serial No. 07/899,105 which issued as Patent No. 5,236,521. An application naming the same inventors directed to related subject matter, Serial No. 07/847,723 was filed March 6, 1992. Said application Serial 07/847,723 was replaced by a continuation application Serial No. 08/023/865 which issued as Patent No. 5,284,529. Said Patent Nos. 5,236,521 and 5,284,529 are hearby incorporated herein by this reference.--.

Signed and Sealed this

Twenty-third Day of July, 1996

*Attest:*

Bruce Lehman

BRUCE LEHMAN

*Attesting Officer*

*Commissioner of Patents and Trademarks*